US007536819B2

(12) United States Patent
Popikow

(10) Patent No.: US 7,536,819 B2
(45) Date of Patent: May 26, 2009

(54) ADJUSTABLE RECOIL PAD FOR A SMALL ARM

(75) Inventor: Sergej Popikow, Weitnau (DE)

(73) Assignee: Blaser Finanzholding GmbH, Isny Im Allgau (DE)

( * ) Notice: Subject to any disclaimer, the term of this patent is extended or adjusted under 35 U.S.C. 154(b) by 281 days.

(21) Appl. No.: 11/346,617

(22) Filed: Feb. 2, 2006

(65) Prior Publication Data

US 2006/0174532 A1 Aug. 10, 2006

(30) Foreign Application Priority Data

Feb. 4, 2005 (DE) ..... 10 2005 004 978

(51) Int. Cl.
*F41C 23/00* (2006.01)

(52) U.S. Cl. ..... 42/74; 42/71.01; 42/73

(58) Field of Classification Search ..... 42/71.01, 42/72, 73, 74, 1.06
See application file for complete search history.

(56) References Cited

U.S. PATENT DOCUMENTS 169,465 A * 11/1875 Miller ..... 42/74
1,088,362 A * 2/1914 Perkins ..... 42/73
1,468,354 A * 9/1923 Caretto ..... 42/74
1,480,350 A * 1/1924 Martin et al. ..... 42/74
2,187,548 A * 1/1940 Smith ..... 42/73
2,787,855 A * 4/1957 Guymon ..... 42/73
4,055,016 A * 10/1977 Katsenes ..... 42/71.01
4,887,374 A * 12/1989 Santarossa ..... 42/73
5,001,855 A * 3/1991 Griggs ..... 42/74
5,711,102 A * 1/1998 Plaster et al. ..... 42/71.01
6,457,273 B2 * 10/2002 Gussalli Beretta ..... 42/73
6,655,068 B2 * 12/2003 Murello et al. ..... 42/74

FOREIGN PATENT DOCUMENTS

DE G8307047.8 7/1983
DE 296 05120 U1 6/1996

* cited by examiner

*Primary Examiner*—Michelle Clement
(74) *Attorney, Agent, or Firm*—Martin Fleit; Paul D. Bianco; Fliet Gibbons Gutman Bongini & Bianco PL

(57) ABSTRACT

The invention concerns an adjustable recoil pad for a small arm, in particular, a rifle, with a base plate that can be adjustably affixed to a stock part of the small arm, a bottom plate which is adjustably mounted on the base plate, and at least one end part that can be affixed to the bottom plate. A simplified adjustment with a large number of adjustment possibilities is made possible in that the bottom plate is arranged so it can swivel about a transverse axis on a connecting piece, which is displaceably guided via guide elements on the base plate, and can be affixed in a desired position by at least one retaining screw.

11 Claims, 4 Drawing Sheets

ADJUSTABLE RECOIL PAD FOR A SMALL ARM

FIELD OF THE INVENTION

The invention concerns an adjustable recoil pad for a small arm, in particular, a rifle.

BACKGROUND OF THE INVENTION

Such a recoil pad is known from DE 296 05 120 U1. The recoil pad described there is especially designed for sports shooters and constructed in such a way that the adjustability of the recoil pad can be suspended after a weapons inspection by a controllable blocking device. This should make it possible to check for compliance with competition rules during the competition. To this end, the recoil pad contains a base plate affixed to the rear end of a stock, on which base plate, an upper part, consisting of a middle part and wing parts affixed to it in a hinge like manner, is adjustably mounted. For the side adjustment of the recoil pad, additional threaded holes, within the sliding block, with stud screws countersinkable therein, are provided. By a corresponding adjustment of the two stud screws, it is possible to attain a lateral tilting of the middle part relative to the base plate. The adjustment of the lateral tilting, however, is relatively cumbersome and cannot be carried out readily without dismantling from the outside. Two additional stud screws located in the sliding bock on a contact surface with the middle part, parallel to the borehole for the affixing screw, must be also adjusted for an additional incline adjustment of the upper part, relative to the base plate. This adjustment also involves a corresponding effort.

The problem of the invention is to create an adjustable recoil pad of the type initially mentioned, which offers a simplified adjustment with a large number of adjustment possibilities.

This problem is solved by an adjustable recoil pad with the characteristics of Claim 1.

Expedient refinements and advantageous embodiments of the invention are the object of the subordinate claims.

SUMMARY OF THE INVENTION

In the recoil pad of the invention, a large number of adjustments can be undertaken in a relatively simple manner. By adjusting the connecting piece, it is possible to change, for example, the height of the recoil pad. The arrangement on the connecting piece of the bottom plate, which can be swivelled around a transverse axis, also makes possible a simple adjustment of the inclination of the bottom plate relative to the base plate. In this way, the so called pitch angle of the recoil pad can be adjusted. Also the base plate can be adjusted, for example, via oblong holes and corresponding retaining screws, on a stock part of the small arm. The base plate can thus be rotated within a predetermined angular range as well as displaced laterally. Thus, the offset of the recoil pad can be adjusted. The adjusting elements can be easily actuated and are extremely stable, so that a desired adjustment is not readily changed. In this way, it is possible to retain a desired adjustment permanently.

In a particularly expedient embodiment, the bottom plate comprises, above the transverse axis, a setscrew whose front end, protruding forwards, is pressed by at least one pressure spring, clamped between the bottom plate and the connecting piece. By adjusting the setscrew, it is thus possible to attain a very simple and nevertheless, stable incline adjustment of the recoil pad.

The transverse axis is preferably located above the middle axis of the bottom plate. A swivel movement of the recoil pad, caused by the recoil, thereby counteracts the kick of the weapon, and the moving axis of the small arm is more likely to remain in the desired target plane.

The guide elements for the displaceable guidance of the connecting piece on the base plate consist, in an expedient embodiment, of a sliding block and a corresponding longitudinal groove in the bottom plate.

To lengthen or shorten the recoil pad, the end part, preferably constructed as an end cap, can be affixed to the bottom plate via one or more spacers. In another advantageous embodiment, passage openings, aligning spacers and the bottom plate with the retaining screws are provided in the end part. In this way, the retaining screws for adjusting the recoil pad are accessible from the outside, even without dismantling the end cap.

BRIEF DESCRIPTION OF THE DRAWINGS

Other special features and advantages of the invention can be deduced from the following description of a preferred embodiment with the aid of the drawing. The figures show the following.

DETAILED DESCRIPTION OF THE INVENTION

Figure 1:
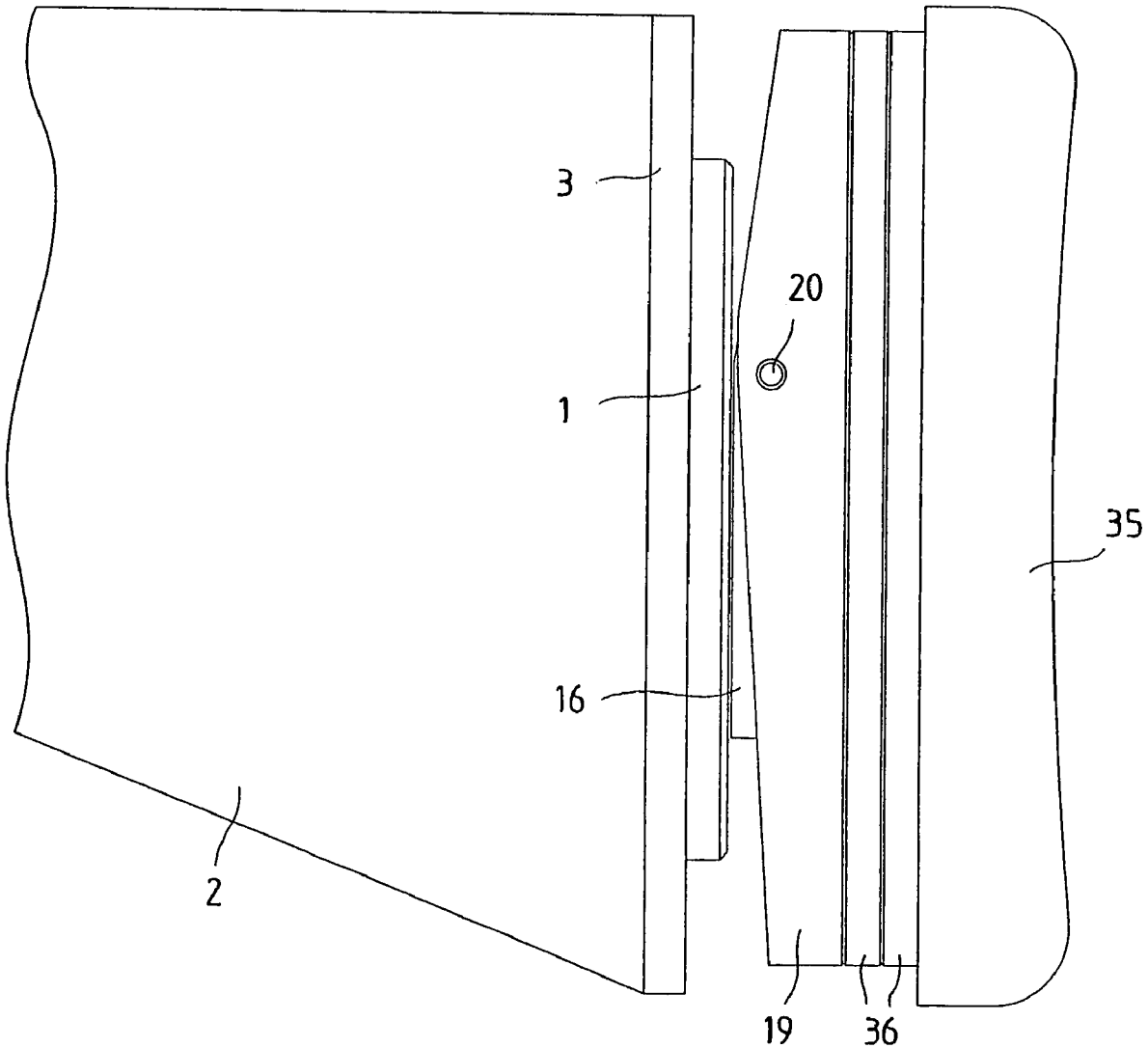
FIG. 1, a recoil pad of the invention, in a side view.

The recoil pad shown in FIGS. 1-4 comprises a base plate 1, which is adjustably affixed to a rear stock part 3, which is affixed on the rear end of a rear stock 2 and is constructed as a stock plate in the embodiment shown. The stock part 3, constructed as a stock plate and fitted to the outside contour of the rear stock 2, is affixed to the rear side of the rear stock 2 by screws 4, shown in FIG. 2. The stock part 3 comprises upper and lower passage openings 5, which have oval recesses 6, recognizable in FIG. 3, on the side pointing to the rear stock 2. Nuts 7 with an oval outside contour fitted to the inside contour of the recesses 6, and threaded holes 8 are located in the oval recesses 6.

Figure 3:
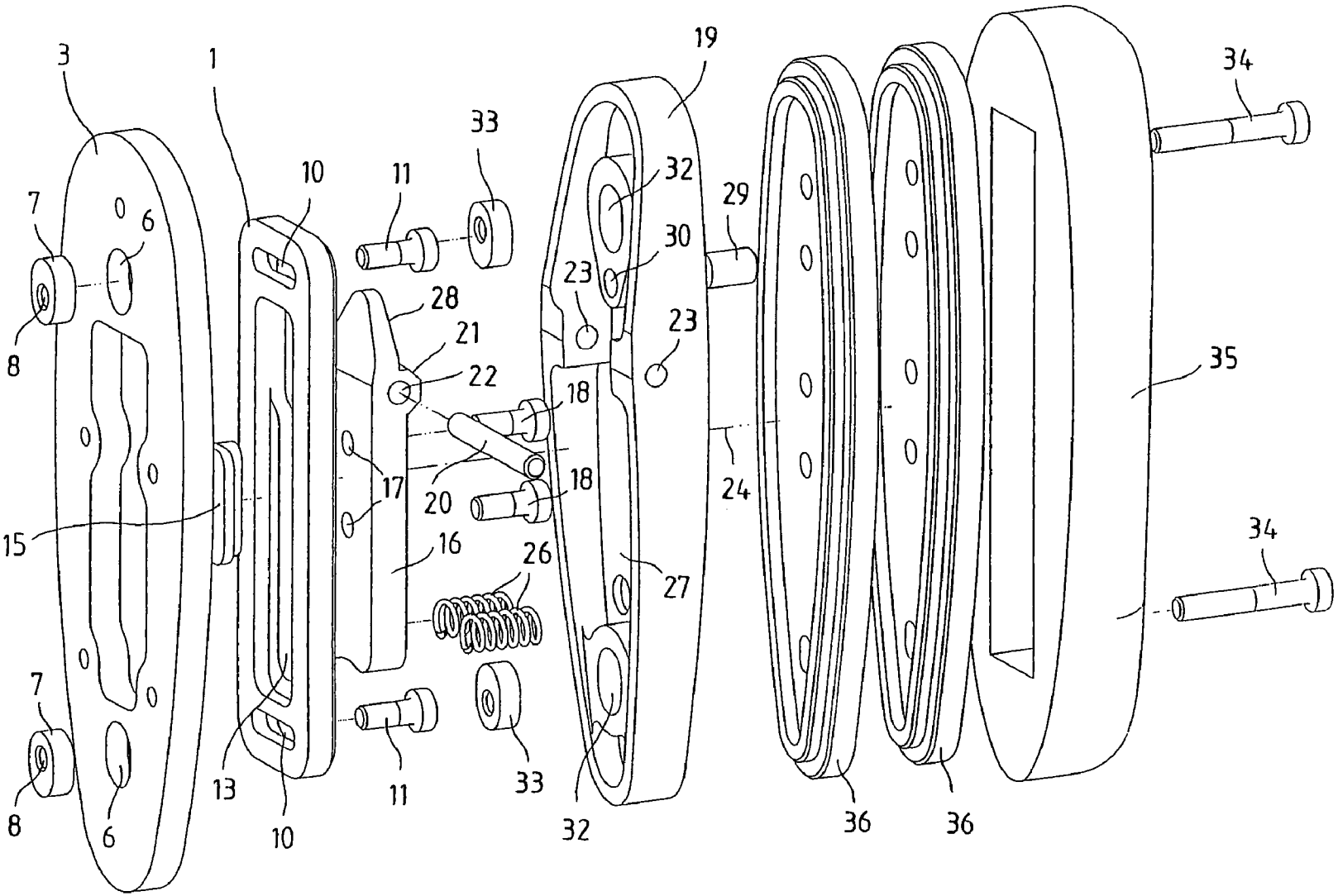
FIG. 3, the recoil pad shown in FIG. 1 in a first exploded view.
Figure 4:
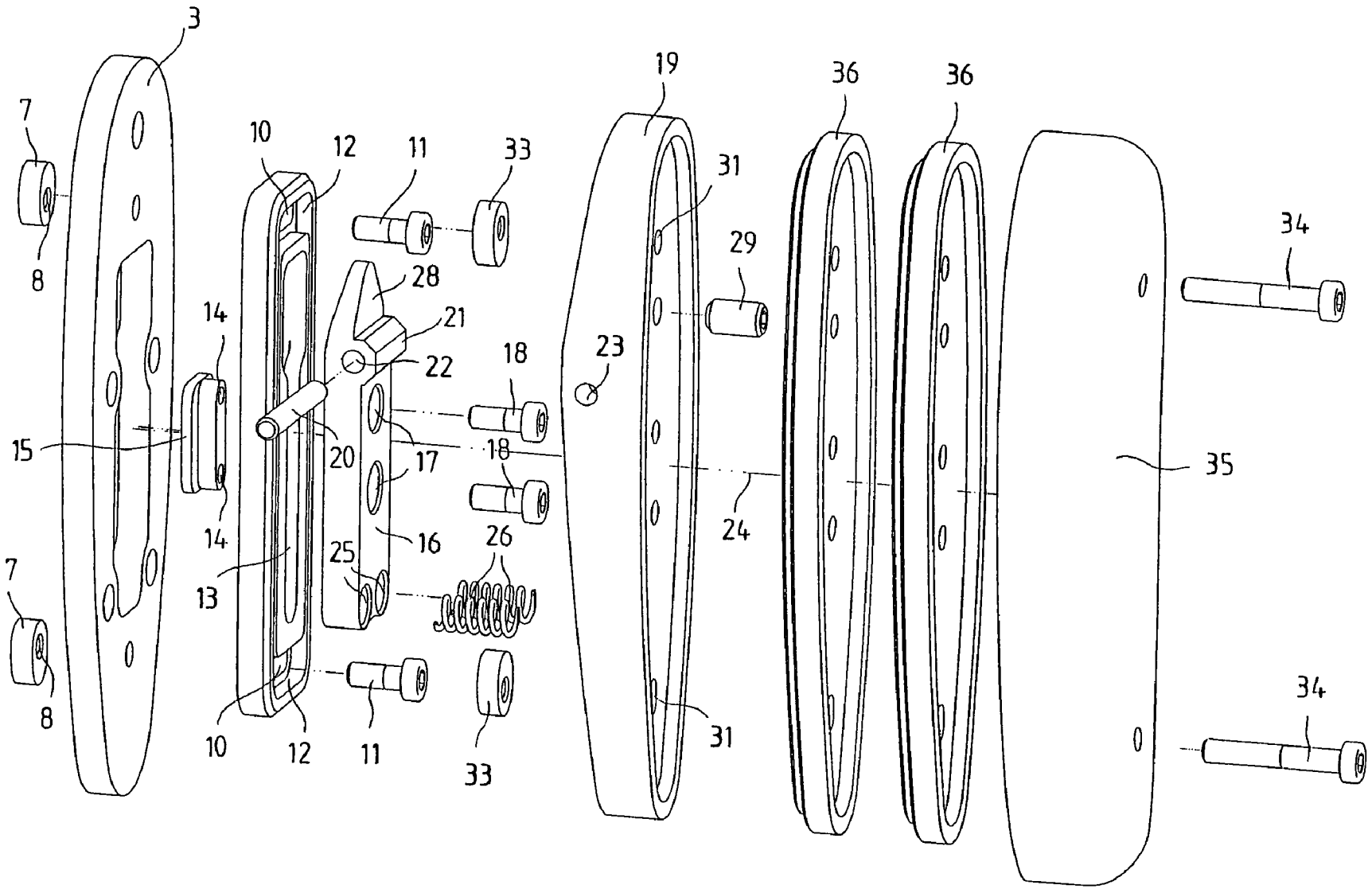
FIG. 4, the recoil pad shown in FIG. 1 in a second blow up exploded view.

As can be seen, in particular, from FIGS. 3 and 4, the base plate 1 has upper and lower transverse slots 10 for two retaining screws 11. The transverse slots 10 are constructed in the form of oblong holes with a recess 12, shown in FIG. 4, on the side used by the stock part 3. The base plate 1 is affixed on the stock part 3 so as to be adjustable via the transverse slots 10 and the retaining screws 11, constructed as cylinder head screws, with the corresponding nuts 7. The transverse slots 10 are dimensioned in such a way that the base plate 1 can be turned by loosening the retaining screws 11 either to the right or left, by a prespecified angle, and also can be displaced laterally in the vertical position.

A longitudinal slot 13 for a T shaped sliding block 15 provided with threaded holes 14 is also provided in the base plate 1, between the upper and lower transverse slot 10. The longitudinal slot 13 comprises a lower guide area, which is also T shaped in cross section, and a broader upper introduction area, which is recognizable in FIG. 4 and into which the sliding block 15 can be inserted. The sliding block 15 can be movably guided upwards and downwards in the lower guide area. A connecting piece 16 is affixed to the rear side of the sliding block 15, turned away from the stock part 3. The connecting piece 16 is affixed via boreholes 17 and two retaining screws 18 to the rear side of the sliding block 15 so that the connecting piece 16 can be displaced upwards or downwards into a desired position, together with the sliding block 15, by loosening the two retaining screws 18 within the guide area of the longitudinal slot 13, and can be fixed in the desired position by tightening the two retaining screws 18. The longitudinal slot 13 and the corresponding sliding block 15 represent guide elements for guiding the connecting piece 16 on the base plate 1.

A bottom plate 19 constructed as a middle piece is articulated so it can swivel around a transverse pin 20 on the connecting piece 16. To this end, the connecting piece 16 has a backwards protruding stop 21, with a transverse borehole 22 for the transverse pin 20 in the upper area. Two lateral seating boreholes 23 for the transverse pin 20 are provided in the bottom plate 19. As can be deduced from the FIGS. 3 and 4, the seating holes 23 are located above the middle axis 24 of the bottom plate 19. Two pocket holes 25, which are recognizable in FIG. 4, for the support of two compression springs 26 are provided on the underside of the connecting piece 16. One of the ends of the two compression springs 26 is supported in each of the two pocket holes 25. The other ends of the pressure springs 26 are supported on a back offset inside surface 27 of the bottom plate 19. The connecting piece 16 also has a lug lying above the borehole 22 with a contact surface 28 on which the front end of a setscrew 29, located in the bottom plate 19, fits snugly. The setscrew 29, constructed as the threaded pin, is located in a threaded through-hole 30 of the bottom plate 19. By turning the setscrew 29, the incline of the bottom plate 19 can be adjusted with regard to the connecting piece 16.

Upper and lower passage boreholes 31 with oval recesses 32, recognizable in FIG. 3, are also provided in the bottom plate 19 on the side turned toward the connecting piece 16. Once again, nuts 33 for two retaining screws 34 matching the nuts 7 are inserted into these recesses 32. An end part 35, constructed here as an end cap, can be affixed to the bottom plate via the nuts 33 and the retaining screws 34. One or more spacers 36 can also be used between the end part 35 and the bottom plate 19, and with these, the distance of the end part 35 from the bottom plate 19 can be changed.

Figure 2:
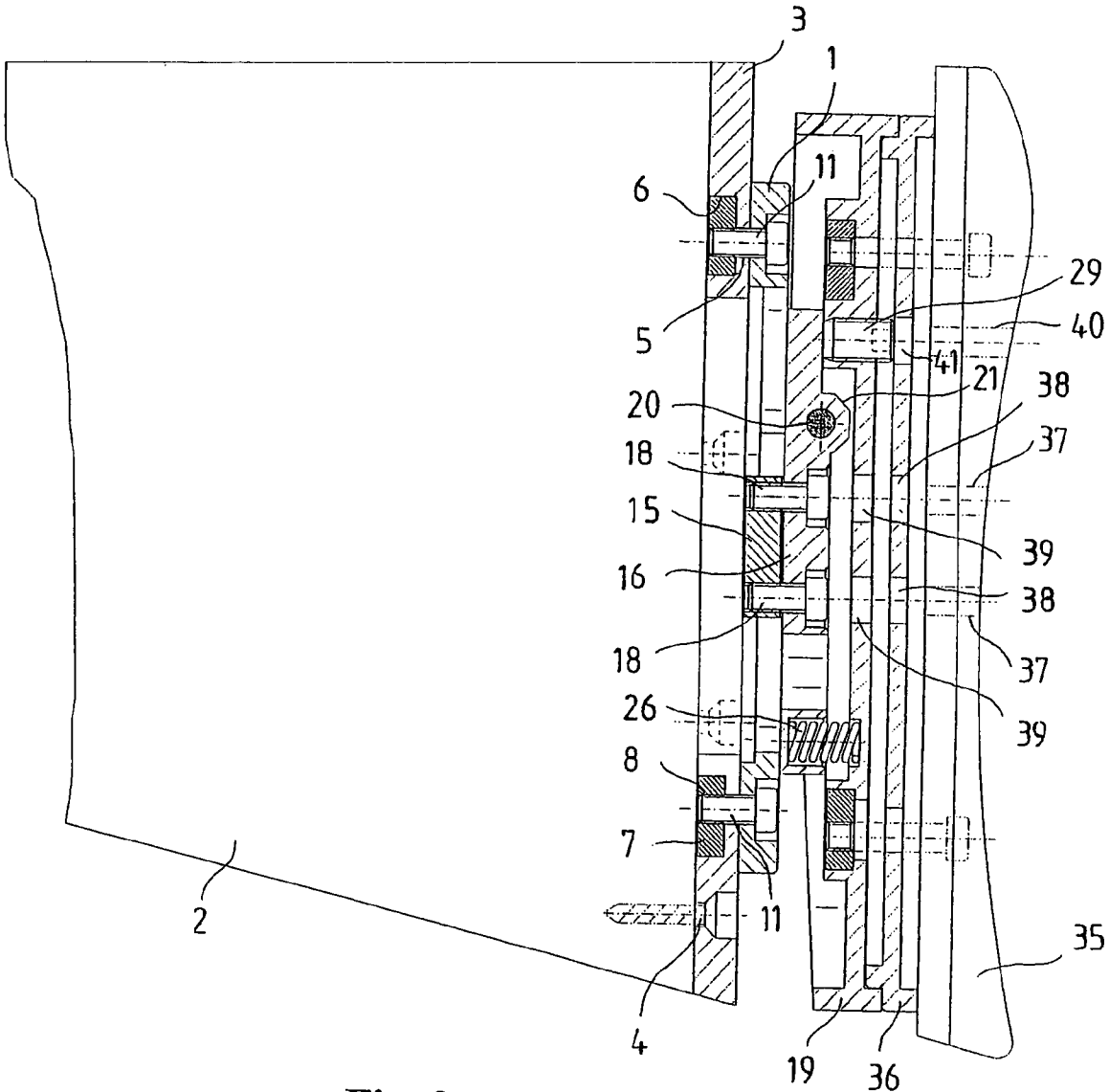
FIG. 2, a recoil pad of the invention, in a longitudinal section.

The retaining screws 11 and 18 are constructed as hex socket cap screws. The setscrew 29 also has a hex socket, so that adjustment of the recoil pad with a single hex key is possible. As can be seen in FIG. 2, passage openings 37 to 41, which align in the end part 35, constructed as an end cap, and in the spacer 36, and the bottom plate 19 with the retaining screws 18 and the setscrew 29, are provided. In this way, the retaining screws 18 and the setscrew 29 are accessible from the outside.

A large number of adjustments of the recoil pad can be undertaken via the base plate 1 and the connecting piece 16 with the swiveling bottom plate 19. Thus, for example, by loosening the screws 11, the base plate 1 can be rotated within an angular range defined by the transverse slots 10 or can be displaced to the side in their vertical position. In this way, a lateral displacement and an adjustment of the offset can be attained. By loosening the retaining screws 18 on the other hand, it is possible to displace the connecting piece 16 upwards and downwards. This allows a height adjustment of the recoil pad. By rotating the setscrew 29, the inclination of the bottom plate 19 can be changed with respect to the base plate 1 and thus the pitch angle can be adjusted.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is embodied by the following claims.

What is claimed is:

1. Adjustable recoil pad for a small arm comprising:

a base plate having guide elements, the base plate being adjustably affixed to a stock part of the small arm by at least one base plate retaining screw;

a bottom plate adjustably mounted on the base plate, the bottom plate being operable to swivel around a transverse axis on a connecting piece, the connecting piece being disposed between the base plate and the bottom plate and displaceably guided by the guide elements of the base plate;

a setscrew disposed within a recess in the bottom plate and above the transverse axis, the setscrew being operable to adjust inclination of the bottom plate;

at least one compression spring compressing a front end of the setscrew against the connecting piece, the at least one compression spring located between the bottom plate and the connecting piece; and at least one end part fixed to the base plate.

2. Adjustable recoil pad according to claim 1, wherein the transverse axis is located above a middle axis of the bottom plate.

3. Adjustable recoil pad according to claim 1, wherein the bottom plate comprises two lateral seating holes for the transverse axis.

4. Adjustable recoil pad according to claim 1, wherein the guide elements for movably guiding the connecting piece on the base plate comprise a sliding block and a corresponding longitudinal slot in the base plate.

5. Adjustable recoil pad according to claim 4, wherein the connecting piece affixable in a desired position by two connecting piece retaining screws, the two connecting piece retaining screws being operable to be screwed into threaded holes of the sliding block.

6. Adjustable recoil pad according to claim 5, wherein the base plate further comprises upper and lower transverse slots for the corresponding base plate retaining screws, the upper and lower transverse slots and corresponding base plate retaining screws being operable to rotate and laterally adjust the base plate.

7. Adjustable recoil pad according to claim 6, wherein the stock part is affixable to a rear stock of the small arm.

8. Adjustable recoil pad according to claim 1, wherein the end part is an end cap affixable to the bottom plate.

9. Adjustable recoil pad according to claim 8, wherein at least one spacer is disposed between the end part and the bottom plate.

10. Adjustable recoil pad according to claim 9, wherein aligned openings through the end part, through the at least one spacer, and through the bottom plate provide access to the base plate retaining screws and the connecting piece retaining screws from outside the end part.

11. Adjustable recoil pad according to claim 10, wherein aligned openings the end part, through the at least one spacer, and through the bottom plate provide access to the setscrew from outside the end part.

* * * * *